US009999798B2

(12) United States Patent
Hannula

(10) Patent No.: US 9,999,798 B2
(45) Date of Patent: Jun. 19, 2018

(54) VERSATILE EXERCISE APPARATUS WITH ADJUSTABLE VOLUME TO WEIGHT RATIO

(71) Applicant: Matthew Joseph Hannula, San Diego, CA (US)

(72) Inventor: Matthew Joseph Hannula, San Diego, CA (US)

( * ) Notice: Subject to any disclaimer, the term of this patent is extended or adjusted under 35 U.S.C. 154(b) by 0 days. days.

(21) Appl. No.: 15/218,908

(22) Filed: Jul. 25, 2016

(65) Prior Publication Data

US 2017/0021221 A1 Jan. 26, 2017

Related U.S. Application Data

(60) Provisional application No. 62/196,962, filed on Jul. 25, 2015.

(51) Int. Cl.

| | |
|---|---|
| ***A63B 69/22*** | (2006.01) |
| ***A63B 69/24*** | (2006.01) |
| ***A63B 69/26*** | (2006.01) |
| ***A45F 4/02*** | (2006.01) |
| ***A63B 21/065*** | (2006.01) |
| ***A63B 21/00*** | (2006.01) |
| ***A63B 69/20*** | (2006.01) |
| ***A63B 21/06*** | (2006.01) |
| ***A63B 21/072*** | (2006.01) |

(Continued)

(52) U.S. Cl.

CPC ..... *A63B 21/065* (2013.01); *A63B 21/0602* (2013.01); *A63B 21/072* (2013.01); *A63B 21/4005* (2015.10); *A63B 69/201* (2013.01); *A63B 21/0603* (2013.01); *A63B 21/0604* (2013.01); *A63B 21/4007* (2015.10); *A63B 21/4009* (2015.10); *A63B 21/4011* (2015.10); *A63B 69/004* (2013.01); *A63B 2071/0694* (2013.01); *A63B 2209/00* (2013.01); *A63B 2225/09* (2013.01); *A63B 2225/62* (2013.01)

(58) Field of Classification Search

CPC ..... A63B 69/20; A63B 69/201; A63B 69/24; A63B 69/26; A63B 69/34; A63B 69/345; A63B 21/0602; A63B 21/0603; A63B 21/0604; A63B 21/065; A63B 21/4005; A45F 2003/166

See application file for complete search history.

(56) References Cited

U.S. PATENT DOCUMENTS 2,826,416 A * 3/1958 Heffner ..... A63B 69/201 482/86
4,332,379 A * 6/1982 Bannister ..... A63B 21/065 224/148.5

(Continued)

*Primary Examiner* — Nyca T Nguyen
(74) *Attorney, Agent, or Firm* — TJSL Patent Clinic; Bridget Madden

(57) ABSTRACT

Versatile exercise apparatus is portable and provides adjustable volume to weight ratio for multi-purpose weight, cardio, sport-specific, and martial arts training. Versatile exercise apparatus provides a user with the ability to adjust volume to weight ratio using a waterproof fillable cavity. The different markings on the transparent viewing window of the apparatus allow a user to vary the difficulty level of workouts by changing the corresponding weight of either water or sand added to the apparatus. Versatility is provided by the apparatus either being used as a backpack or a hand-held free weight, or a punching bag.

12 Claims, 5 Drawing Sheets

(51) Int. Cl.
*A63B 69/00* (2006.01)
*A63B 71/06* (2006.01)

(56) References Cited

U.S. PATENT DOCUMENTS 4,357,009 A 11/1982 Baker
5,941,640 A 8/1999 Thatcher
6,216,926 B1 * 4/2001 Pratt ..... A45F 3/04 224/148.2
8,109,863 B2 * 2/2012 Gilberti ..... A63B 21/0603 473/438
2008/0193113 A1 * 8/2008 Yeom ..... A45C 11/38 396/27
2009/0279810 A1 * 11/2009 Nobles ..... A45C 13/00 383/66
2012/0091294 A1 * 4/2012 Cuadrado ..... A63B 69/201 248/95
2012/0246884 A1 * 10/2012 Wilson ..... A63B 69/004 24/302
2013/0072357 A1 * 3/2013 Galvan ..... A63B 69/34 482/83
2013/0310229 A1 * 11/2013 Kovach ..... A63B 21/0004 482/106
2014/0051559 A1 * 2/2014 Flentye ..... A63B 23/0355 482/139
2014/0254956 A1 * 9/2014 Buell, III ..... B65D 33/00 383/64
2014/0309089 A1 * 10/2014 Buikema ..... A63B 21/065 482/105
2014/0339277 A1 * 11/2014 Law ..... A45C 11/22 224/259
2014/0353347 A1 * 12/2014 Fischer ..... A45C 13/10 224/148.4
2015/0011366 A1 * 1/2015 Hockridge ..... A63B 69/205 482/87
2015/0093052 A1 * 4/2015 Hoskins ..... B65D 33/24 383/68
2015/0141220 A1 * 5/2015 Wargo ..... A63B 21/0602 482/139
2016/0129292 A1 * 5/2016 Stroup ..... A63B 21/00065 482/93
2016/0130040 A1 * 5/2016 Yeh ..... A45C 13/008 383/63

* cited by examiner

VERSATILE EXERCISE APPARATUS WITH ADJUSTABLE VOLUME TO WEIGHT RATIO

CROSS-REFERENCE TO RELATED APPLICATION

The present application claims the benefit of U.S. Provisional Patent Application No. 62/196,962, filed on Jul. 25, 2015, entitled "Adjustable Volume to Weight Ratio Exercise Apparatus," the entire invention of which is incorporated by reference herein.

FIELD OF THE INVENTION

The present invention relates to an exercise apparatus, and particularly to a portable and adjustable volume to weight ratio exercise apparatus used for multi-purpose weight, cardio, sport-specific, and martial arts training.

BACKGROUND

When a person desires to weight train, their options are limited to joining a gym, hiring a personal trainer with access to weights, or purchasing weights themselves. All of these options are incredibly expensive both in the short and long term. Gyms and personal trainers typically require costly fees and long-term financial commitments for regular access to and use of weights. Similarly, purchasing weights for home use can be exponentially expensive considering achieving weight variation requires purchasing a multiplicity of weights. Additionally, weights for home use present additional storage and portability issues that increase the general burden of maintaining them for personal use.

A number of patents have issued for portable weight devices for exercise. For example, U.S. Pat. No. 4,332,379, provides a collapsible exercise back pack wherein a user can manipulate the weight of the back pack. While the device itself acts as a portable weight, the apparatus does not provide a user with the ability to use the device as a hand-held free weight. Also, this device does not provide a means for a user to determine the varying weight of the device. Accordingly, there is a need for an apparatus that overcomes the aforementioned problems.

SUMMARY OF THE INVENTION

The present invention, in its many embodiments, provides a versatile exercise apparatus providing a user with the ability to adjust the volume to weight ratio using a waterproof fillable cavity. Accordingly, the object of the present invention is to minimize costs to a user by providing a versatile exercise apparatus for multi-purpose weight, cardio, sport-specific, and martial arts training.

In an exemplary embodiment, the present invention is directed to an apparatus for portable and versatile exercise training with a waterproof fillable cavity. The waterproof fillable cavity comprises a rear portion, front portion, bottom portion, two side portions, and a top portion. In an exemplary embodiment, the top portion further comprises an opening with a watertight mechanism configured to open and close the waterproof fillable cavity.

In an exemplary embodiment, the watertight mechanism is a tongue and groove system, but other water tight sealing method known to those of skill in the art can be used. A pair of shoulder straps are secured to the rear portion of the waterproof fillable cavity, which allow the user to carry the apparatus on his/her back during training exercises or for everyday use. A plurality of vertical hand straps are secured to the two side portions of the waterproof fillable cavity to allow the user to lift the apparatus like a free weight. Since the vertical straps are placed at various different positions along the versatile exercise apparatus, the user can shift his/her hand to perform a variety of weight training exercises. A plurality of horizontal hand straps are secured to the front portion of the waterproof fillable cavity. These front straps provide yet another way that a user can lift the apparatus. A waist strap is secured to the rear portion of the waterproof fillable cavity. Along with a waist securing mechanism, the waist strap allows a user to carry the weight of the versatile exercise apparatus on his/her hips. Shifting the weight of the versatile exercise apparatus to a user's hips allows the user to carry more weight for an increased duration, and shifts excess load away from the users shoulders to prevent injury to a user due to the increased weight. Since the versatile exercise apparatus allows users to carry more weight than they normally could in a back pack with only shoulder straps, users will be able to workout harder and reach their training goals faster.

In an exemplary embodiment, the transparent viewing windows in the first side portion of the waterproof fillable cavity allow the user to view the contents of the waterproof fillable cavity. The transparent viewing window has volume indicators imprinted on the surface to allow the user to know and regulate the amount of liquid or solid particulates in the waterproof fillable cavity. In an embodiment, the plurality of the D-rings are fixed on the top portion of the waterproof fillable cavity so the top clips, located at the edges of the opening, can keep the opening secure when it is rolled down. Rolling down the opening and clipping the top clips to the D-rings, gives the user further protection from the release of the contents of the waterproof fillable cavity. In an embodiment, a suspension strap can be removably attached to the plurality of D-rings to allow the user to hang the versatile exercise apparatus.

In an exemplary embodiment, the suspension strap has a fastening device that is connected by a long strap to a ring. Short straps are attached to the ring on one end and a plurality of hooks on the other end. The length of the long strap allows it to be looped around an object so the fastening device can connect to the D-rings. In an embodiment, when the fastening device is hooked to the D-rings, and the long strap wrapped around an object, the versatile exercise apparatus can be suspended from the object. With the versatile exercise apparatus suspended in the air, it can be used as a martial arts training device like a punching bag. In an embodiment, by varying the contents of the waterproof fillable cavity, a user can adjust the firmness of the versatile exercise apparatus to meet his/her needs.

In an exemplary embodiment, the vertical hand straps and the horizontal hand straps have a gripping material on their surface to assist the user in gripping the straps while lifting the apparatus.

In one embodiment, a versatile exercise apparatus comprises a waterproof fillable cavity comprising a rear portion, a front portion, a bottom portion, a first side portion, a second side portion, and a top portion comprising an opening; wherein said opening of the top portion further comprises a watertight mechanism configured to open and close the waterproof fillable cavity; and wherein the opening of the top portion further comprises an upper end and a lower end; a pair of shoulder straps secured to the rear portion of the waterproof fillable cavity; a plurality of vertical hand straps secured to the second side portion of the waterproof fillable cavity; a plurality of horizontal hand straps secured to the front portion of the waterproof fillable cavity; a waist strap secured to the rear portion of the waterproof fillable cavity; a waist securing mechanism secured to the waist strap; a transparent viewing window secured to the first side portion of the waterproof fillable cavity; a plurality of D-rings secured to the top portion of the waterproof fillable cavity; a plurality of top clips secured at the lower and the upper end of the opening; wherein, the plurality of top clips attach to the plurality of D-rings to secure the top portion; and a suspension strap removably attached to the plurality of D-rings.

In yet another embodiment, the suspension strap further comprises a ring; a plurality of hooks; a fastening device; a plurality of short straps, wherein one end of the plurality of short straps are attached to the ring and another end of the plurality of short straps are attached to the plurality of hooks; and a long strap, wherein on end of the long strap is attached to the ring and another end of the long strap is attached to the fastening device.

In still another embodiment, a versatile exercise apparatus comprises a gripping material on the plurality of vertical hand straps and the plurality of horizontal hand straps to allow for the versatile exercise apparatus to be lifted by using either the plurality of vertical hand straps or the plurality of horizontal hand straps.

In yet another embodiment, the weight of a versatile exercise apparatus is adjusted by adding or removing a liquid or a solid particulate from the waterproof fillable cavity through the opening.

In another embodiment, a pair of shoulder straps and a waist securing mechanism are configured to allow a user to wear the versatile exercise apparatus as a weighted backpack.

In still another embodiment, a transparent viewing window further comprises a plurality of indicator marks, which correspond to the volume of the liquid or the volume of the solid particulate in the waterproof fillable cavity.

In another exemplary embodiment, a suspension strap is configured to suspend the versatile exercise apparatus from an object by connecting the plurality of hooks to the plurality of D-rings; looping the long strap around the object; and connecting the fastening device to the ring.

In a further embodiment, a versatile exercise apparatus comprises a waterproof fillable cavity comprising a rear portion, a front portion, a bottom portion, a first side portion, a second side portion, and a top portion comprising an opening; wherein the opening of the top portion further comprises a watertight mechanism configured to open and close the waterproof fillable cavity; a pair of shoulder straps secured to the rear portion of the waterproof fillable cavity; a plurality of vertical hand straps secured to the second side portion of the waterproof fillable cavity; a plurality of horizontal hand straps secured to the front portion of the waterproof fillable cavity; a waist strap secured to the rear portion of the waterproof fillable cavity; a waist securing mechanism secured to the waist strap; a transparent viewing window secured to the first side portion of the waterproof fillable cavity. In one embodiment, a plurality of D-rings secured to the top portion of the waterproof fillable cavity; a plurality of top clips secured near the watertight mechanism and the opening; and a suspension strap fixed to the plurality of D-rings.

In yet another embodiment, the suspension strap further comprises a ring; a fastening device; a plurality of hooks; a plurality of short straps, wherein one end of the plurality of short straps are attached to the ring and another end of the plurality of short straps are attached to the plurality of hooks; and a long strap, wherein on end of the long strap is attached to the ring and another end of the long strap is attached to the fastening device.

In still another embodiment, the plurality of vertical hand straps and the plurality of horizontal hand straps comprise a gripping material to allow for the versatile exercise apparatus to be lifted by using either the plurality of vertical hand straps or the plurality of horizontal hand straps.

In another embodiment, a pair of shoulder straps and a waist securing mechanism are configured to allow a user to wear the versatile exercise apparatus as a weighted backpack.

In still another embodiment, the weight of a versatile exercise apparatus is adjusted by adding or removing a liquid or a solid particulate from the waterproof fillable cavity through its opening.

In another embodiment, a transparent viewing window further comprises a plurality of indicator marks, which correspond to the volume of the liquid the volume of the solid particulate volume in the waterproof fillable cavity.

In a further embodiment, a suspension strap is configured to suspend the versatile exercise apparatus from an object by looping the long strap around the object; and connecting the fastening device to the ring.

In still another embodiment, a versatile exercise apparatus comprises a waterproof fillable cavity comprising a rear portion, a front portion, a bottom portion, a top portion comprising an opening, a first side portion, and a second side portion; a watertight mechanism at the opening of the top portion of the waterproof fillable cavity, further comprising a roll top, an opposed coupling structure, and a plurality of top clips.

In yet another embodiment, a pair of shoulder straps secured to the rear portion of the waterproof fillable cavity; a plurality of vertical hand straps secured to the second side portion of the waterproof fillable cavity, wherein a gripping material is secured to the plurality of vertical hand straps; plurality of horizontal hand straps secured to the front portion of the waterproof fillable cavity, wherein a gripping material is secured to the plurality of horizontal hand straps; a waist securing mechanism secured to the rear portion of the waterproof fillable cavity; and a transparent viewing window secured to the first side portion of the waterproof fillable cavity, further comprising a plurality of indicator marks.

In another embodiment, wherein the weight of the versatile exercise apparatus is adjusted by adding or removing a liquid or a solid particulate from the waterproof fillable cavity through the opening.

In still another embodiment, the transparent viewing window further comprises a plurality of indicator marks, which correspond to the volume of the liquid or the solid particulate in the waterproof fillable cavity.

In yet another embodiment, a suspension strap is configured to suspend the versatile exercise apparatus from an object by looping the long strap around the object; and connecting the fastening device to the ring.

In a further another embodiment, a plurality of vertical hand straps and the plurality of horizontal hand straps are configured to allow a user to lift the versatile exercise apparatus.

In still another embodiment, a pair of shoulder straps and the waist securing mechanism are configured to allow a user to wear the versatile exercise apparatus as a weighted backpack.

DESCRIPTION OF THE FIGURES

Embodiments of the invention will now be described, by way of example only, with reference to the accompanying figures.

DETAILED DESCRIPTION

Figure 1:
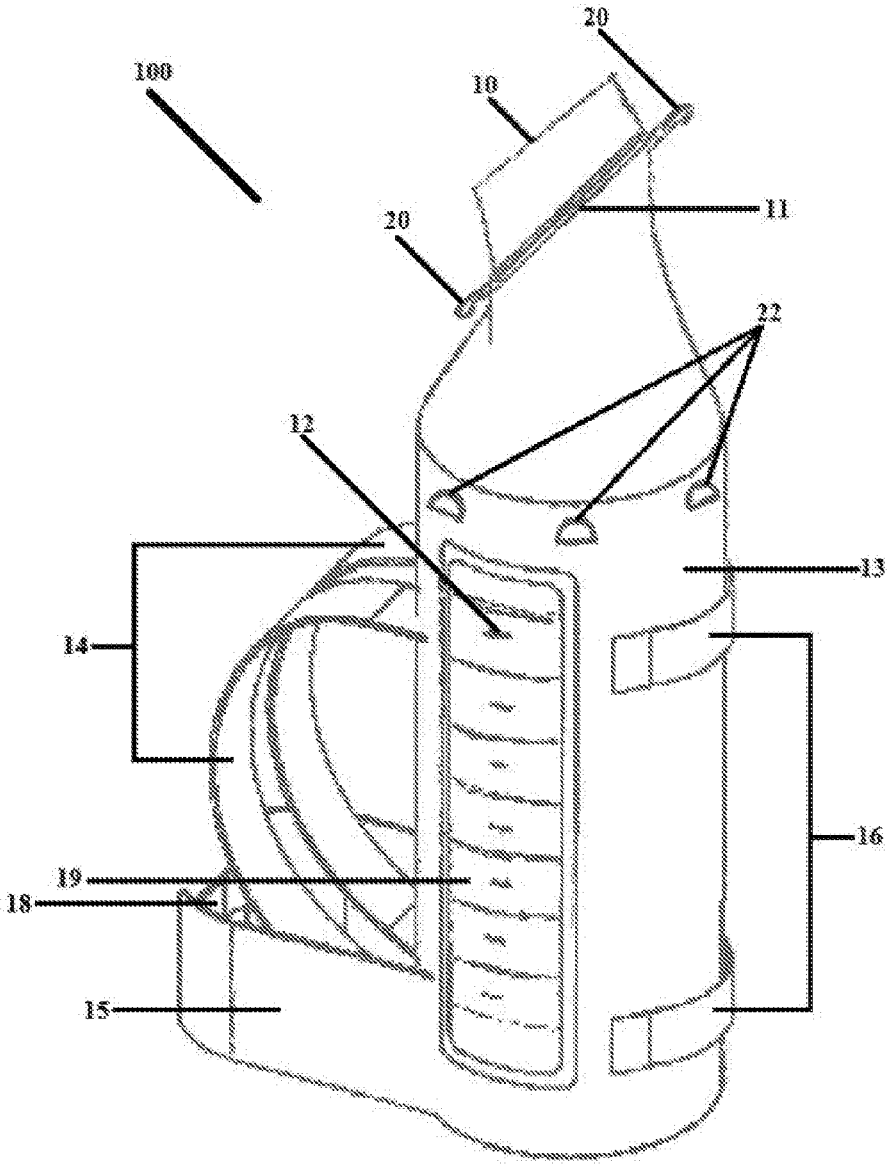
FIG. 1 illustrates a front perspective view of an exemplary embodiment of a versatile exercise apparatus in accordance with the principles of the present invention.

The following detailed description is merely exemplary in nature and is not intended to limit the application and uses of the disclosure. As used herein, the word "exemplary" means "serving as an example, instance, or illustration." Thus, any embodiment described herein as "exemplary" is not necessarily to be construed as preferred or advantageous over other embodiments. Furthermore, there is no intention to be bound by any expressed or implied theory presented in the preceding technical field, background, brief summary, or the following detailed description.

In this description, reference is made to the drawings, wherein like parts are designated with like reference numerals throughout. As used in the description herein and throughout, the meaning of "a," "an," and "said" includes plural reference unless the context clearly dictates otherwise. Also, as used in the description herein, the meaning of "in" includes "into" and "on" unless the context clearly dictates otherwise.

As used herein, and unless the context dictates otherwise, the term "versatile exercise apparatus" is intended to include versatile exercise apparatus with adjustable volume to weight ratio. Therefore, the terms "versatile exercise apparatus", and "versatile exercise apparatus with adjustable volume to weight ratio," may be used interchangeably.

Exemplary embodiments of a versatile exercise apparatus with adjustable volume to weight ratio 100 are schematically depicted in FIGS. 1-4. In reference to FIGS. 1-4, a user may adjust the weight of the versatile exercise apparatus 100 by varying the volume of water or sand filled into opening 11 of waterproof fillable cavity 13.

As illustrated in FIG. 1, versatile exercise apparatus 100 comprises waterproof fillable cavity 13, opening 11, watertight mechanism 10, transparent viewing window 19, plurality of indicator marks 12, pair of shoulder straps 14, waist strap 15, waist securing mechanism 18, plurality of horizontal hand straps 16, top clips 20, and plurality of D-rings 22. In one embodiment, opening 11 further comprises upper end 11*a* and lower end 11*b*. In an embodiment, plurality of top clips 20 are located at upper end 11*a* and lower end 11*b* of opening 11, so a user can hook to plurality of D-rings 22 to provide an additional seal against the contents of waterproof fillable cavity 13. In an embodiment, pair of shoulder straps 14 and waist strap 15 are positioned to allow a user to carry versatile exercise apparatus 100 on his/her back. In one embodiment, waist securing mechanism 18 is configured to hold versatile exercise apparatus 100 on the user's back, even during vigorous exercises.

In one exemplary embodiment, waterproof fillable cavity 13 further comprises a transparent viewing window 19 further comprising a plurality of indicator marks 12 to show the corresponding volume and weight of versatile exercise apparatus 100 either filled with liquid or a solid particulate. In another exemplary embodiment, a user adjusts the weight of versatile exercise apparatus 100 by adding or removing a liquid such as water or solid particulates from waterproof fillable cavity 13. In on embodiment, plurality of horizontal hand straps 16 and plurality of vertical hand straps 17 also allow a user to lift versatile exercise apparatus 100 as a hand-held free weight when exercising. In another embodiment, plurality of horizontal hand straps 16 allows a user to grip waterproof fillable cavity 13 at different places so the user can perform a variety of different workouts.

In an alternative embodiment, plurality of horizontal hand straps 16 and plurality of vertical hand straps 17 further comprise a gripping material on their surfaces to allow a user to have a better grasp of versatile exercise apparatus 100 as a hand-held free weight when exercising. The gripping material allows a user to firmly grasp heavier weights, but further prevents a user from doing exercises that require the versatile exercise apparatus 100 to shift in the user's hands. One such exercise that is impaired is a power clean, which requires a user to shift the weight of the versatile exercise apparatus 100 from one side of the user's hands to another.

In another exemplary embodiment, waterproof fillable cavity 13 comprises a rear portion, a front portion, a bottom portion, a top portion, and an opening 11 at the top portion, and a first side portion and a second side portion opposite the first side portion. In one embodiment, the first side portion further comprises transparent viewing window 19 and the second side portion further comprises plurality of vertical hand straps 17. In an embodiment, waterproof fillable cavity 13 comprises an enclosed bottom portion and opening 11 on the opposite top portion of waterproof fillable cavity 13. In one embodiment, opening 11 is closed and opened by watertight mechanism 10 (not shown).

In one exemplary embodiment, transparent viewing window 19 on the first side portion of waterproof fillable cavity 13 further comprises a plurality of indicator marks 12, corresponding to the liquid volume at a certain weight inside of the versatile exercise apparatus 100 and/or to the solid volume at a certain weight inside of the versatile exercise apparatus 100. In one embodiment, plurality of indicator marks 12 allows a user to accurately adjust the volume to weight ratio of versatile exercise apparatus 100.

Figure 2:
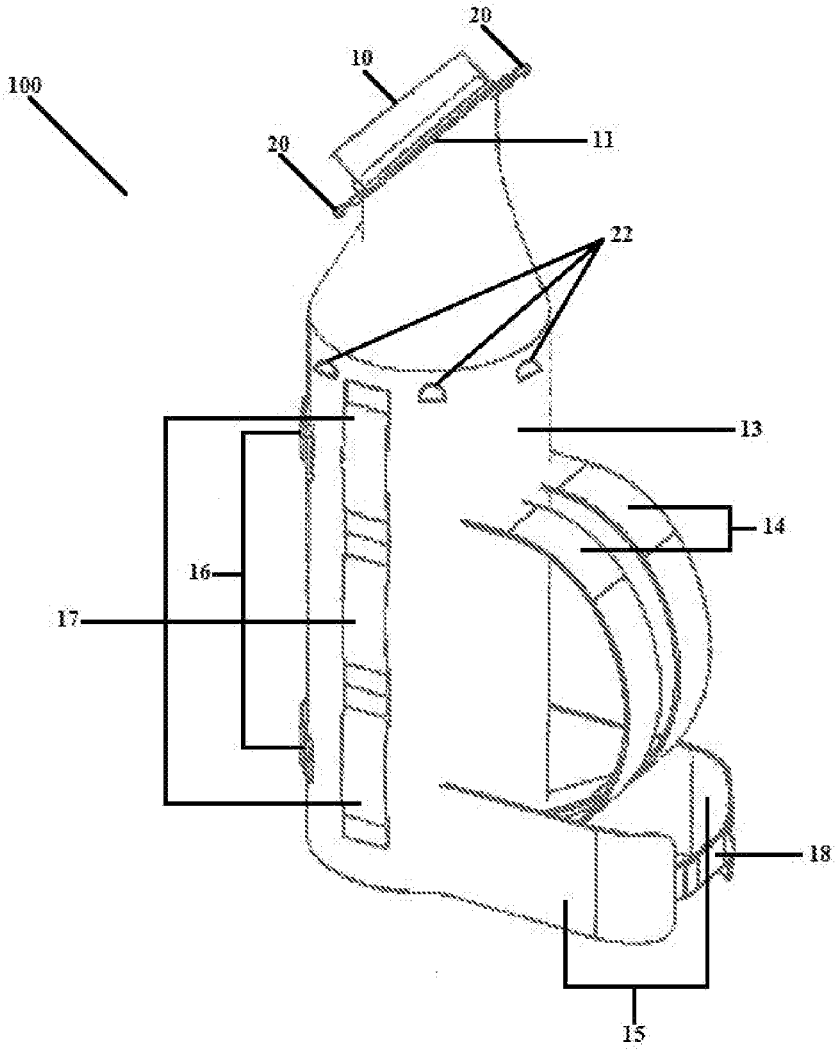
FIG. 2 illustrates a rear perspective view of an exemplary embodiment of a versatile exercise apparatus in accordance with the principles of the present invention.

In FIG. 2, versatile exercise apparatus 100 comprises waterproof fillable cavity 13, opening 11, watertight mechanism 10, pair of shoulder straps 14, waist strap 15, waist securing mechanism 18, plurality of horizontal hand straps 16, plurality of vertical straps 17, plurality of top clips 20, and plurality of D-rings 22. In one exemplary embodiment, plurality of vertical straps 17 span the entire length of waterproof fillable cavity 13, so a user can perform a variety of exercises that require different hand positions.

In an alternative embodiment, plurality of horizontal hand straps 16 and plurality of vertical hand straps 17 further have a gripping material on their surfaces to allow a user to have a better grasp of versatile exercise apparatus 100 as a hand-held free weight when exercising. The gripping material allows a user to firmly grasp heavier weights, but prevents a user from doing exercises that require the versatile exercise apparatus 100 to shift in the users hands. One such exercise that will be impaired is a power clean, which requires the user to shift the weight of the versatile exercise apparatus 100 from one side of their hands to another.

Figure 3:
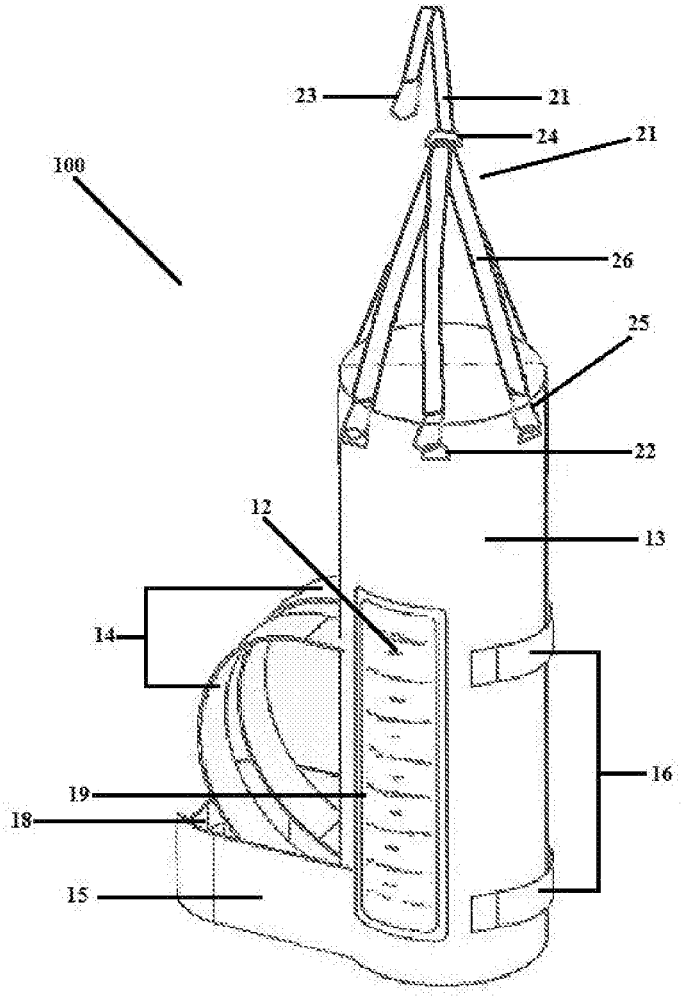
FIG. 3 illustrates a front perspective view of an exemplary embodiment of a versatile exercise apparatus in accordance with the principles of the present invention.

As shown in FIG. 3, versatile exercise apparatus 100 comprises waterproof fillable cavity 13 with the opening 11 (see FIGS. 1-2) rolled down with watertight mechanism 10 (see FIGS. 1-2) closed, transparent viewing window 19, plurality of indicator marks 12, pair of shoulder straps 14, waist strap 15, waist securing mechanism 18, plurality of horizontal hand straps 16, plurality of D-rings 22, suspension strap 21, fastening device 23, ring 24, plurality of hooks 25, plurality of short straps 26, and long strap 27. In one embodiment, plurality of vertical straps 17 span the entire length of waterproof fillable cavity 13, so the user can perform a variety of exercises that require different hand positions. Plurality of hooks 25 attach to plurality of D-rings 22, to allow the user to hang versatile exercise apparatus 100 by throwing long strap 27 over an object and hooking fastening device 23 to ring 24.

Figure 4:
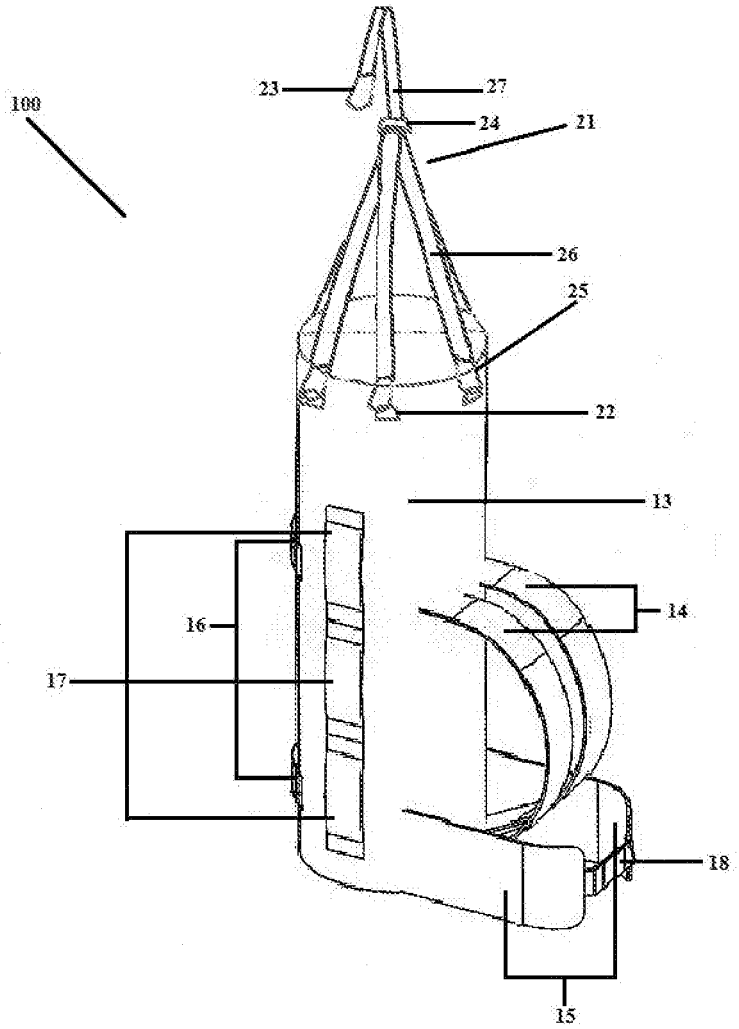
FIG. 4 illustrates a rear perspective view of an exemplary embodiment of a versatile exercise apparatus in accordance with the principles of the present invention.

In FIG. 4, versatile exercise apparatus 100 comprises waterproof fillable cavity 13 with opening 11 (see FIGS. 1-2) rolled down and the watertight mechanism (see FIGS. 1-2) closed, pair of shoulder straps 14, waist strap 15, waist securing mechanism 18, plurality of horizontal hand straps 16, plurality of vertical straps 17, plurality of D-rings 22, suspension strap 21, fastening device 23, ring 24, plurality of hooks 25, plurality of short straps 26, and long strap 27.

Figure 5:
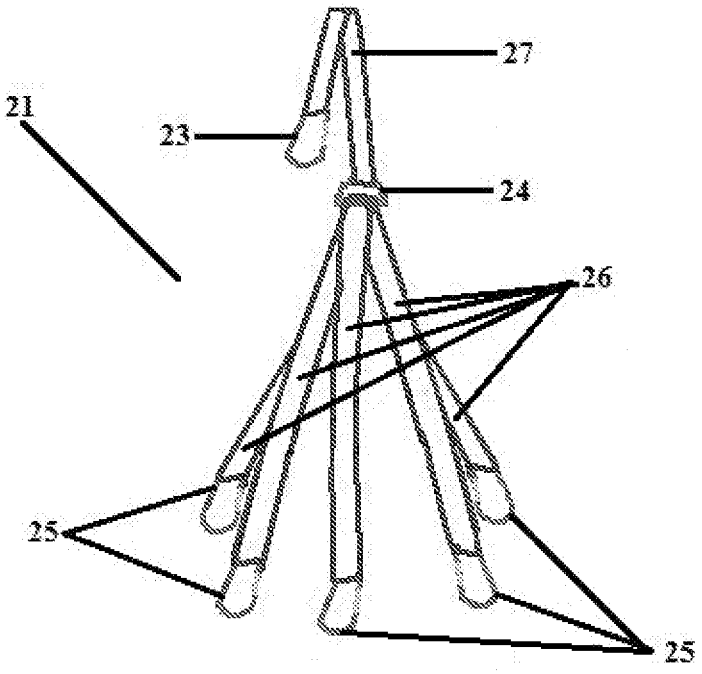
FIG. 5 illustrates a front perspective view of an exemplary embodiment of a suspension strap in accordance with the principles of the present invention.

FIG. 5 is an exemplary embodiment illustrating suspension strap 21 with fastening device 23, ring 24, plurality of hooks 25, plurality of short straps 26, and long strap 27.

In an alternative embodiment, waterproof fillable cavity 13 comprises opening 11 securely sealed by watertight mechanism 10 (see FIGS. 1-2). Watertight mechanism 10 at opening 11 of waterproof fillable cavity 13 comprises an opposed coupling structure, a roll top, and a clip (not shown). In an exemplary embodiment, the opposed coupling structure further comprises a first horizontal panel, a second horizontal panel, and a sliding fastener. In another exemplary embodiment, the first horizontal panel and the second horizontal panel further comprise complementary projections, wherein the projections on the first horizontal panel complement the projections on the second horizontal panel. In yet another exemplary embodiment, the projections of the first horizontal panel are capable of coupling with the projections of said second horizontal panel to securely seal opening 11 (not shown). In an exemplary embodiment, the roll top of watertight mechanism 10 of opening 11 extends past the first horizontal panel, the second horizontal panel, and the sliding fastener of the opposed coupling structure (not shown).

In an exemplary embodiment, the first horizontal panel and the second horizontal panel further comprise a first end and a second end, respectively. In one embodiment, the sliding fastener attaches over the top of the first horizontal panel and the second horizontal panel to form the opposed coupling structure, wherein the projections of the first horizontal panel and the projections of the second horizontal panel act as counterparts to seal watertight mechanism 10 of opening 11 by a user moving the sliding fastener in the direction of the second end of the first horizontal panel and the second end of the second horizontal panel to force the complementary projections of the first horizontal panel and the second horizontal panel to securely connect with one another (not shown). In a further exemplary embodiment, a user moving the sliding fastener in the opposite direction towards the first end of the first horizontal panel and the first end of the second horizontal panel unseals watertight mechanism 10 of opening 11 (not shown).

In an exemplary embodiment, once the first horizontal panel and the second horizontal panel are securely sealed together by the sliding fastener, watertight mechanism 10 of versatile exercise apparatus 100 completely closes opening 11 when a user rolls the roll top tightly down and then secures the roll top of watertight mechanism 10 in place by the clip. In an embodiment, water or sand may be removed from waterproof fillable cavity 13 when a user is finished exercising by unclipping the clip, unrolling the roll top, and moving the sliding fastener towards the first end of the first horizontal panel and the first end of the second horizontal panel of watertight mechanism 10 to unseal opening 11 (not shown).

Thus, specific embodiments of a versatile exercise apparatus and methods to employ such an apparatus have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. A versatile exercise apparatus comprising:

a) a waterproof fillable cavity comprising a rear portion, a front portion, a bottom portion, a first side portion, a second side portion, and a top portion comprising an opening;

wherein said opening of said top portion further comprises a watertight mechanism configured to open and close said waterproof fillable cavity; and wherein said opening of said top portion further comprises an upper end and a lower end;

b) a pair of shoulder straps secured to said rear portion of said waterproof fillable cavity;

c) a plurality of vertical hand straps secured to said second side portion of said waterproof fillable cavity;

d) a plurality of horizontal hand straps secured to said front portion of said waterproof fillable cavity;

e) a transparent viewing window secured to said first side portion of said waterproof fillable cavity;

f) a plurality of D-rings secured to said top portion of said waterproof fillable cavity;

g) a plurality of top clips secured at said lower and said upper end of said opening;

wherein, said plurality of top clips attach to said plurality of D-rings to secure said top portion; and h) a suspension strap removably attached to said plurality of D-rings;

wherein, said suspension strap further comprises:

i) a ring;

ii) a plurality of hooks;

iii) a fastening device;

iv) a plurality of short straps, wherein one end of said plurality of short straps are attached to said ring and another end of said plurality of short straps are attached to said plurality of hooks; and v) a long strap, wherein one end of said long strap is attached to said ring and another end of said long strap is attached to said fastening device.

2. The versatile exercise apparatus of claim 1, further comprising a gripping material on said plurality of vertical hand straps and said plurality of horizontal hand straps to allow for said versatile exercise apparatus to be lifted by using either said plurality of vertical hand straps or said plurality of horizontal hand straps.

3. The versatile exercise apparatus of claim 1, wherein the weight of said versatile exercise apparatus is adjusted by adding or removing a liquid or a solid particulate from said waterproof fillable cavity through said opening.

4. The versatile exercise apparatus of claim 1, wherein said pair of shoulder straps is configured to allow a user to wear said versatile exercise apparatus as a weighted backpack.

5. The versatile exercise apparatus of claim 1, wherein said transparent viewing window further comprises a plurality of indicator marks which correspond to a volume of liquid or a volume of solid particulate in said waterproof fillable cavity.

6. The versatile exercise apparatus of claim 1, wherein said suspension strap is configured to suspend said versatile exercise apparatus from an object by:

i) connecting said plurality of hooks to said plurality of D-rings;

ii) looping said long strap around said object; and iii) connecting said fastening device to said ring.

7. A versatile exercise apparatus comprising:

a) a waterproof fillable cavity comprising a rear portion, a front portion, a bottom portion, a first side portion, a second side portion, and a top portion comprising an opening;

wherein said opening of said top portion further comprises a watertight mechanism configured to open and close said waterproof fillable cavity;

b) a pair of shoulder straps secured to said rear portion of said waterproof fillable cavity;

c) a plurality of vertical hand straps secured to said second side portion of said waterproof fillable cavity;

d) a plurality of horizontal hand straps secured to said front portion of said waterproof fillable cavity;

e) a transparent viewing window secured to said first side portion of said waterproof fillable cavity;

f) a plurality of D-rings secured to said top portion of said waterproof fillable cavity;

g) a plurality of top clips secured near said watertight mechanism and said opening; and h) a suspension strap fixed to said plurality of D-rings; wherein, said suspension strap further comprises:

i) a ring;

ii) a fastening device;

iii) a plurality of hooks;

iv) a plurality of short straps, wherein one end of said plurality of short straps are attached to said ring and another end of said plurality of short straps are attached to said plurality of hooks; and v) a long strap, wherein one end of said long strap is attached to said ring and another end of said long strap is attached to said fastening device.

8. The versatile exercise apparatus of claim 7, further comprising a gripping material on said plurality of vertical hand straps and said plurality of horizontal hand straps to allow for said versatile exercise apparatus to be lifted by using either said plurality of vertical hand straps or said plurality of horizontal hand straps.

9. The versatile exercise apparatus of claim 7, wherein said pair of shoulder straps is configured to allow a user to wear said versatile exercise apparatus as a weighted backpack.

10. The versatile exercise apparatus of claim 7, wherein the weight of said versatile exercise apparatus is adjusted by adding or removing a liquid or a solid particulate from said waterproof fillable cavity through said opening.

11. The versatile exercise apparatus of claim 7, wherein said transparent viewing window further comprises a plurality of indicator marks which correspond to a volume of a liquid or a volume of solid particulate in said waterproof fillable cavity.

12. The versatile exercise apparatus of claim 7, wherein said suspension strap is configured to suspend said versatile exercise apparatus from an object by:

i) looping said long strap around said object; and ii) connecting said fastening device to said ring.

* * * * *